US007918342B2

(12) United States Patent
Fresnel

(10) Patent No.: US 7,918,342 B2
(45) Date of Patent: Apr. 5, 2011

(54) PROTECTIVE AND PACKAGING WRAPPER FOR A CONTAINER, THE WRAPPER BEING CONSTITUTED BY A SLEEVE OF HEAT-SHRINK PLASTICS MATERIAL

(75) Inventor: Eric Fresnel, Paris (FR)

(73) Assignee: Sleever International Company, Morangis (FR)

( * ) Notice: Subject to any disclaimer, the term of this patent is extended or adjusted under 35 U.S.C. 154(b) by 0 days.

(21) Appl. No.: 12/814,852

(22) Filed: Jun. 14, 2010

(65) Prior Publication Data

US 2010/0326867 A1 Dec. 30, 2010

(30) Foreign Application Priority Data

Jun. 30, 2009 (FR) ..... 09 03177

(51) Int. Cl.
*B65D 65/18* (2006.01)
*B65D 71/08* (2006.01)

(52) U.S. Cl. ..... 206/772; 206/497; 229/87.06

(58) Field of Classification Search ..... 206/769, 206/772, 773, 774, 497, 459.5; 229/87.01, 229/87.06, 89

See application file for complete search history.

(56) References Cited

U.S. PATENT DOCUMENTS

| | | | | |
|---|---|---|---|---|
| 3,312,337 | A * | 4/1967 | Martin | 206/497 |
| 3,516,537 | A * | 6/1970 | Griffiths et al. | 206/497 |
| 3,533,501 | A * | 10/1970 | Dorsett | 206/0.82 |
| 3,885,671 | A * | 5/1975 | Spiegel et al. | 206/460 |
| 5,605,230 | A * | 2/1997 | Marino et al. | 206/534 |
| 2005/0029146 | A1 * | 2/2005 | Compton et al. | 206/459.5 |
| 2007/0059500 | A1 * | 3/2007 | Benson | 428/207 |
| 2007/0095721 | A1 * | 5/2007 | Davis et al. | 206/581 |
| 2008/0190802 | A1 * | 8/2008 | Chiu | 206/497 |
| 2009/0308406 | A1 * | 12/2009 | Sinclair et al. | 131/281 |
| 2010/0025278 | A1 * | 2/2010 | Tilton | 206/459.5 |

FOREIGN PATENT DOCUMENTS

| | | | |
|---|---|---|---|
| DE | 883700 | C | 7/1953 |
| EP | 0 879 189 | B1 | 7/1999 |
| EP | 1 294 614 | B1 | 8/2004 |
| EP | 1 082 256 | B1 | 12/2004 |
| EP | 1 790 578 | A1 | 11/2005 |
| EP | 1 513 739 | B1 | 8/2007 |
| WO | 97/28062 | A1 | 8/1997 |
| WO | 02/00518 | A1 | 1/2002 |

OTHER PUBLICATIONS

French Search Report for Serial No. FR 0903177 dated Nov. 2, 2009.

* cited by examiner

*Primary Examiner* — Jacob K Ackun, Jr.
(74) *Attorney, Agent, or Firm* — McCormick, Paulding & Huber LLP

(57) ABSTRACT

The invention relates to a protective and packaging wrapper for a container, the wrapper being constituted by a sleeve of heat-shrink plastics material for shrinking onto the container, said sleeve being obtained from a film that is folded in half and looped by bonding together two corresponding end zones. In accordance with the invention, the film constituting the sleeve is opaque to light over its entire area with the exception of a window zone, and the above-mentioned window zone is covered on the outside face of the sleeve by a detachable adhesive strip that is opaque to light, removal of said adhesive strip giving access to the window zone and making it possible to observe the substance present inside the container directly by eye.

16 Claims, 5 Drawing Sheets

Fig.1
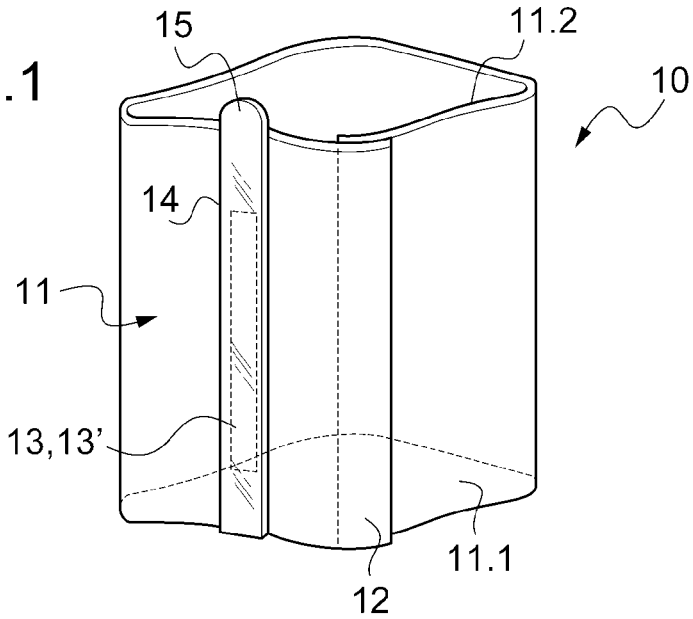
Fig.2
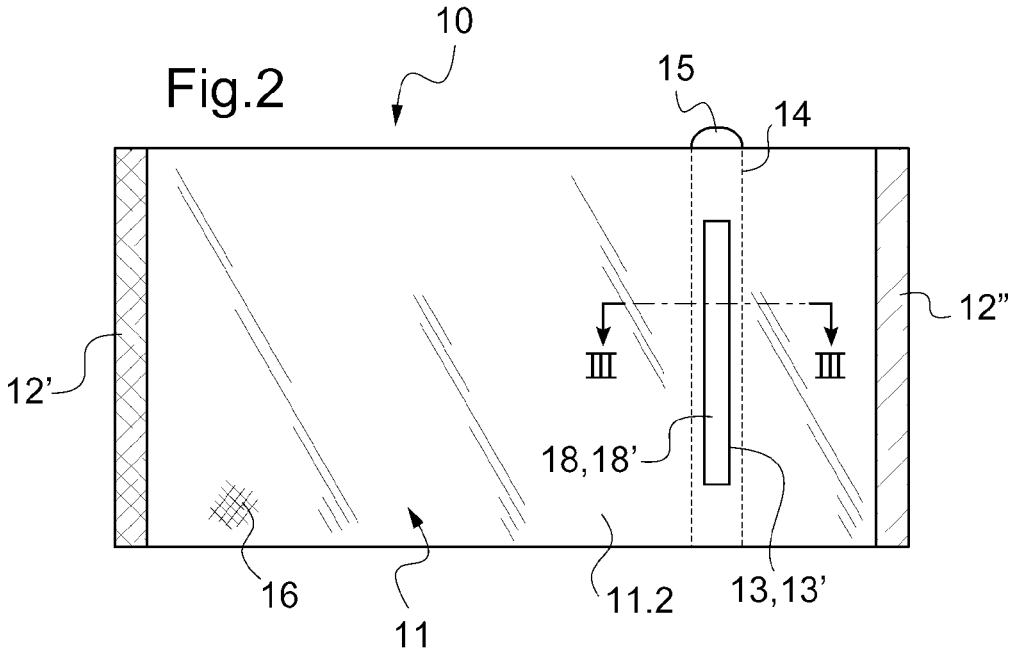
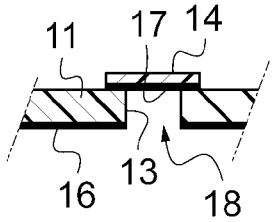
Fig.3a
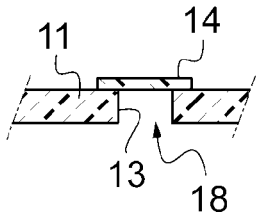
Fig.3b
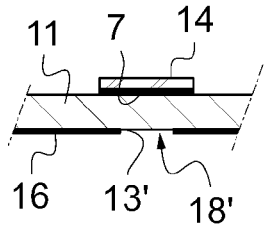
Fig.3c Fig.4
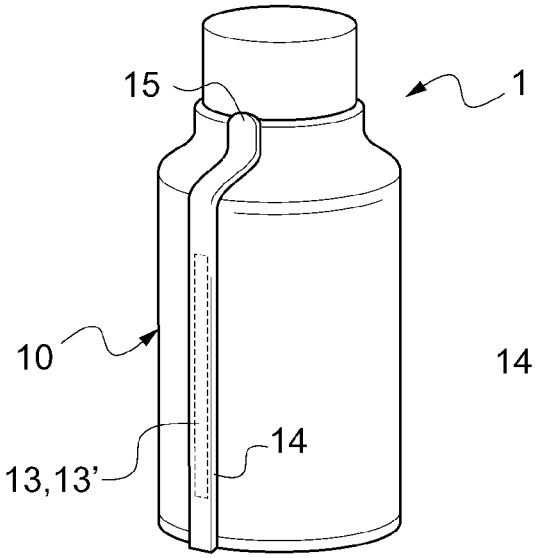
Fig.5
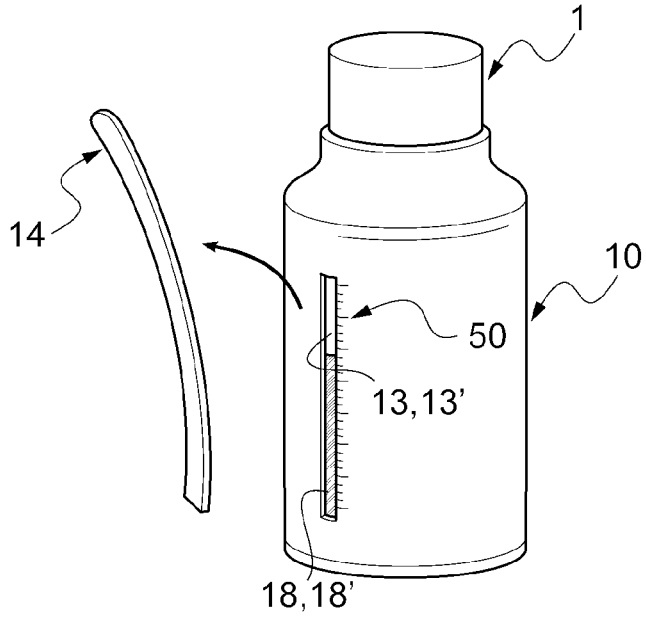
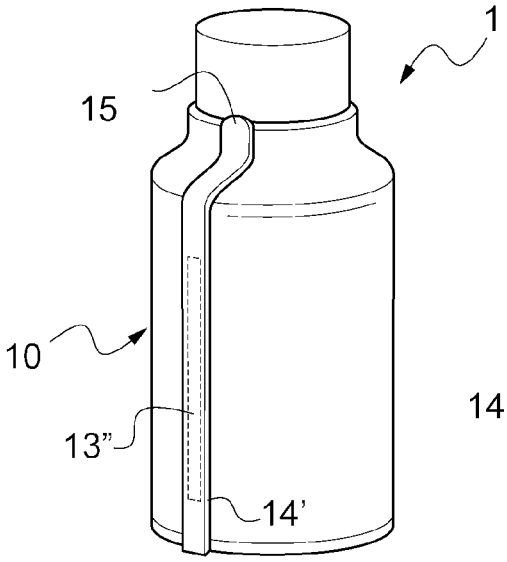
Fig.9
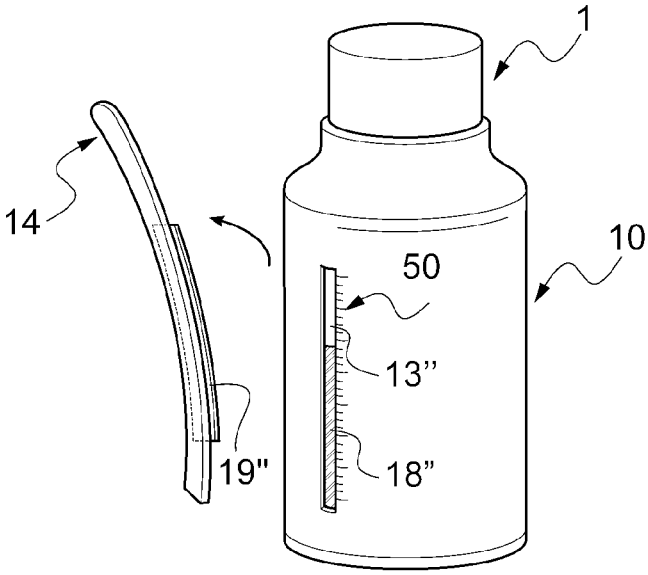
Fig.10

Fig.6
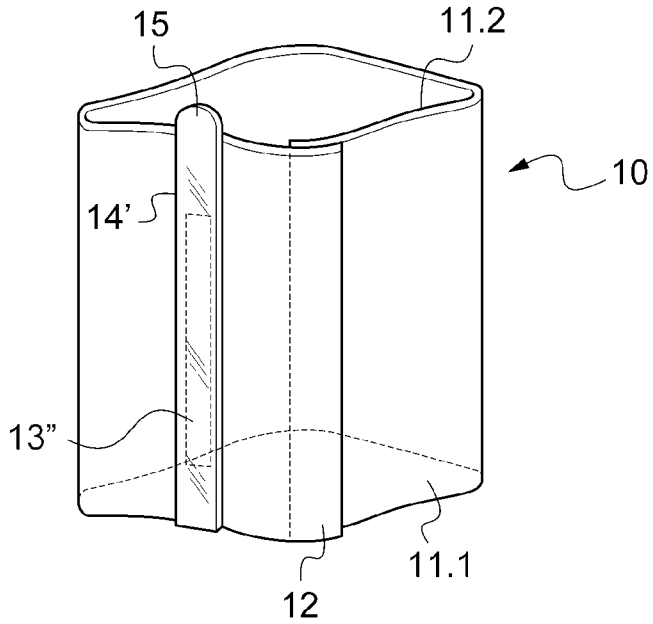
Fig.7
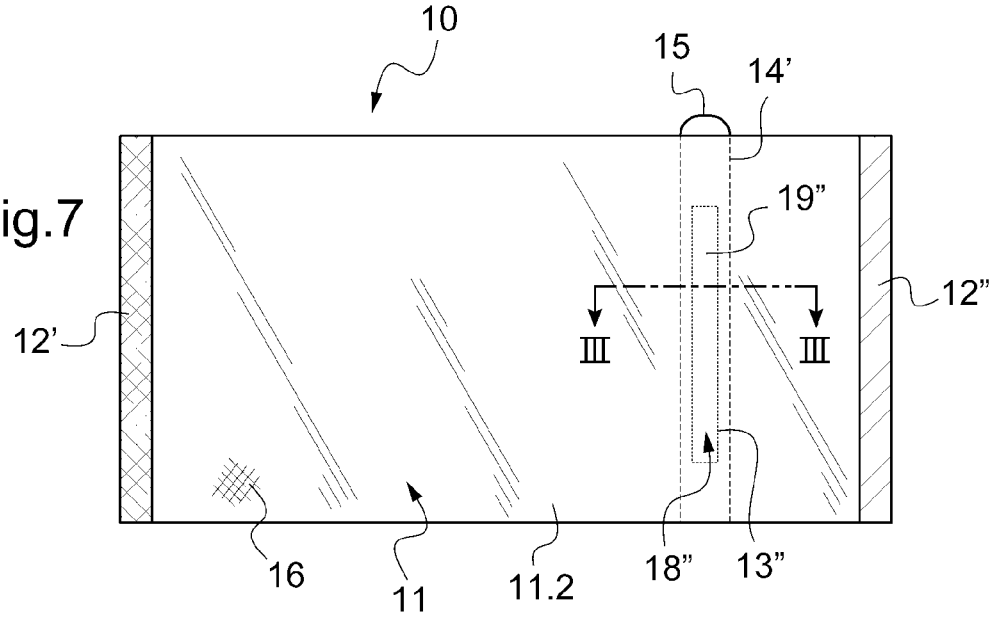
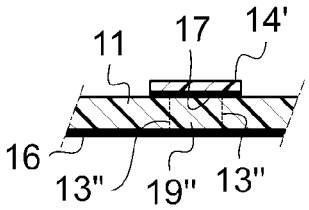
Fig.8a
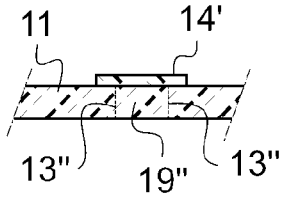
Fig.8b

Fig.11
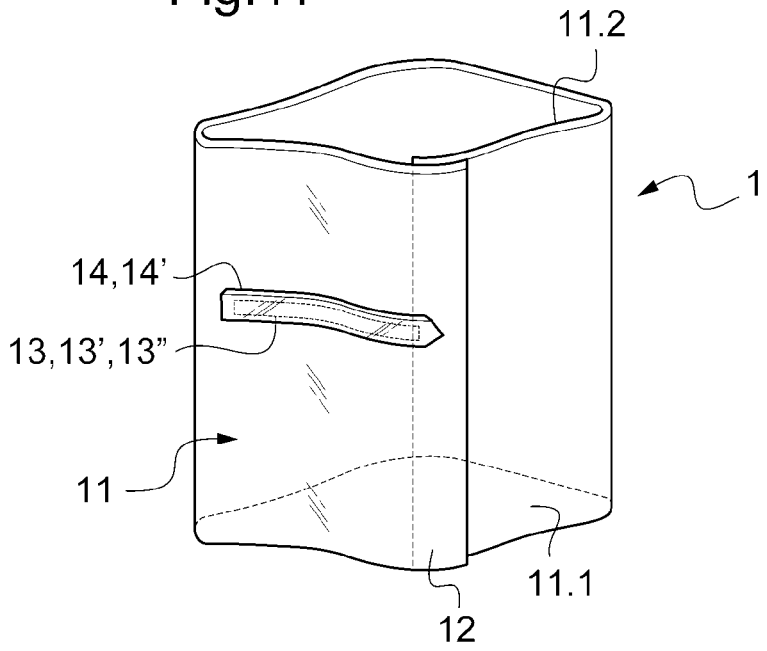
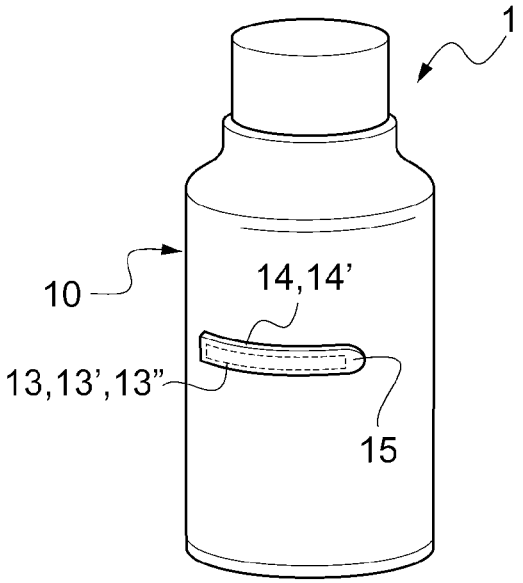
Fig.12
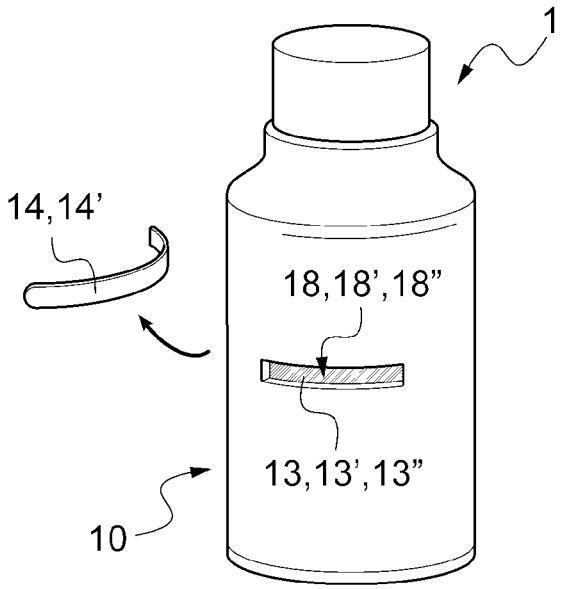
Fig.13

PROTECTIVE AND PACKAGING WRAPPER FOR A CONTAINER, THE WRAPPER BEING CONSTITUTED BY A SLEEVE OF HEAT-SHRINK PLASTICS MATERIAL

CROSS REFERENCE TO RELATED APPLICATION

Applicant hereby claims foreign priority benefits under U.S.C. §119 from French Patent Application No. 09 03177 filed on Jun. 30, 2009, the contents of which are incorporated by reference herein.

FIELD OF THE INVENTION

The present invention relates to protecting and packaging articles, and more particularly containers, by means of a wrapper that is constituted by a sheet of heat-shrink plastics material for shrinking onto the container.

BACKGROUND OF THE INVENTION

Over the last thirty years, a technique of packaging articles has been used in which a heat-shrink film implemented in the form of a sleeve is engaged on the article(s) for packaging, and is then heat-shrunk thereon. In general, the sleeve is obtained from a film that is folded in half and looped by bonding together its two corresponding end zones.

To illustrate this technological background, reference may be made to numerous patent documents in the name of the Applicant, and in particular to documents EP-0 879 189 B1, EP-1 082 256 B1, EP-1 294 614 B1, and EP-1 513 739 B1.

Reference may also be made to document EP-1 790 578 A1 that describes a rotatable sleeve of heat-shrink plastics material presenting one or two windows for viewing inscriptions that are on the outside surface of the wrapped container.

Finally, the technological background is illustrated by document DE-883 700 C that shows a label adhesively bonded via its vertical edges, and leaving a central portion that is detachable.

In several domains, for example the food, pharmaceutical, or medical domains, it is necessary to protect substances contained in a container from light radiation, in particular ultraviolet (UV) radiation, with this applying both to the visible spectrum and to the invisible spectrum, i.e. for wavelengths up to 500 nanometers (nm). By way of example, in the food domain, mention may be made of milk products where a light barrier is necessary in order to preserve the color, the vitamin components, and the organoleptic properties of the products concerned. In the pharmaceutical or medical domains, mention may also be made of packaging substances for perfusion, transfusion, or cancer treatments. Finally, transfusion substances that are mixed together extemporaneously, may also need to be protected from light radiation.

In these various domains, it can be necessary to verify the level of substance within the container, or to verify the presence of substance therein, or indeed to verify the mixing of a plurality of substances, when it is desired to verify that they are indeed miscible.

Unfortunately, specialists are then confronted with a difficulty, since there is contradiction between providing overall protection against light radiation over the entire side surface of the container, and allowing the presence of the substance or the level of the substance in the container to be verified by eye. In this context, it should be observed that a line of microperforations defining a detachable window would suffice to negate the light-barrier property, and is therefore not suitable.

SUMMARY OF THE INVENTION

An object of the invention is to devise a protective and packaging wrapper for a container implementing the well-understood technique of heat-shrinking a sleeve on said container, and making it possible, at least at the time the substance present in the container is used, to verify it by eye from the outside without negating its protection from light radiation.

The above-mentioned technical problem is solved in accordance with the invention by means of a protective and packaging wrapper for a container, the wrapper being constituted by a sleeve of heat-shrink plastics material for shrinking onto the container, said sleeve being obtained from a film that is folded in half and looped by bonding together its two corresponding end zones, said wrapper being remarkable in that the film constituting the sleeve is opaque to light over its entire area with the exception of a window zone, and the above-mentioned window zone is covered on the outside face of the sleeve by a detachable adhesive strip that is opaque to light, removal of said adhesive strip giving access to the window zone and making it possible to observe the substance present inside the container directly by eye.

Thus, so long as the adhesive strip is present on the sleeve, the protection of the substance against light radiation, in particular UV radiation, remains total over the entire periphery of the sleeve, and as soon as the adhesive strip has been removed, in particular at the time of use, simple means are obtained for enabling the level of the substance or the presence of such substance in the container to be verified by eye.

In particular, for containers that contain milk products, such as baby bottles, it is possible in use to verify the level of liquid present in the container, possibly also while simultaneously observing a scale previously printed in the vicinity of the window zone.

In a first embodiment, the film constituting the sleeve is a film of white material that is coated on its face that is to constitute the inside face of said sleeve, in a layer of opaque agent conferring a light-barrier property to said film.

Provision may then be made for the window zone to be constituted by a coating interruption zone in the layer of opaque agent. In particular, the coating interruption zone is arranged to form a narrow slot.

In another embodiment, the film constituting the sleeve is a film that is itself opaque, being made of a material that presents a light-barrier property.

In either embodiment, provision may be made for the window zone to be constituted by a cutout formed in the wall of the sleeve, said cutout defining at least one through opening. In particular, the cutout is arranged to form a narrow slot.

In a variant, provision may be made for the window zone to be constituted by at least one line of microperforations formed in the wall of the sleeve, said at least one line of microperforations defining a through opening after the corresponding zone has been removed. In particular, the line of microperforations is arranged to form a narrow slot.

When a window zone is constituted by at least one line of microperforations, it is particularly advantageous to make provision for the detachable adhesive strip also to be a tear-off strip, removal of said strip simultaneously giving access to the window zone and removing the corresponding zone. This then enables both to be removed in a single highly ergonomic action in order to access the window zone.

In all embodiments, provision may be made for the narrow slot to extend along a generator line of the sleeve, or in a variant to extend circumferentially, over at least a fraction of the periphery of the sleeve.

Concerning the detachable adhesive strip, provision may be made for it to be made from a film of white material coated on its face that faces towards the outside face of the sleeve in a layer of opaque agent conferring a light-barrier property to said strip.

In a variant, the detachable adhesive strip may be made from a film of opaque material that presents a light-barrier property.

Other characteristics and advantages of the invention appear more clearly in the light of the following description and the accompanying drawings.

BRIEF DESCRIPTION OF THE DRAWINGS

Reference is made to the figures of the accompanying drawings, in which:

FIG. 1 is a perspective view showing a protective and packaging wrapper in accordance with the invention, with its light-opaque detachable adhesive strip that masks a window zone;

FIG. 2 is a plan view of the developed inside surface of the sleeve constituting the above-mentioned wrapper;

FIGS. 3*a*, 3*b*, and 3*c* are sections on III-III of FIG. 2 showing different variant embodiments for the window zone and for the detachable adhesive strip that covers it;

FIG. 4 shows the above-mentioned protective and packaging wrapper heat-shrunk onto a container, and FIG. 5 shows the same assembly after the detachable adhesive strip has been removed;

FIG. 6 is a perspective view showing a variant of the protective and packaging wrapper of the invention, in which the window zone is no longer constituted by a cutout or removal of opaque coating, but by a line of microperforations, and also in which the detachable adhesive strip is furthermore a tear-off strip;

FIG. 7 is a plan view analogous to that of FIG. 2 showing the developed inside face of the wrapper of FIG. 6;

FIGS. 8*a* and 8*b* are sections on VIII-VIII of FIG. 7 showing two variant arrangements with microperforations;

FIGS. 9 and 10 show the FIG. 6 protective and packaging wrapper heat-shrunk onto a container, respectively before and after removal of the detachable adhesive strip that is then also likewise a tear-off strip;

FIG. 11 is a perspective view showing yet another variant, with an arrangement in which the window zone no longer extends along a generator line of the sleeve, but circumferentially;

FIGS. 12 and 13 show the protective and packaging wrapper of FIG. 11 heat-shrunk onto a container, respectively before and after removal of the detachable adhesive strip;

DETAILED DESCRIPTION OF THE PREFERRED EMBODIMENT

Figure 14:
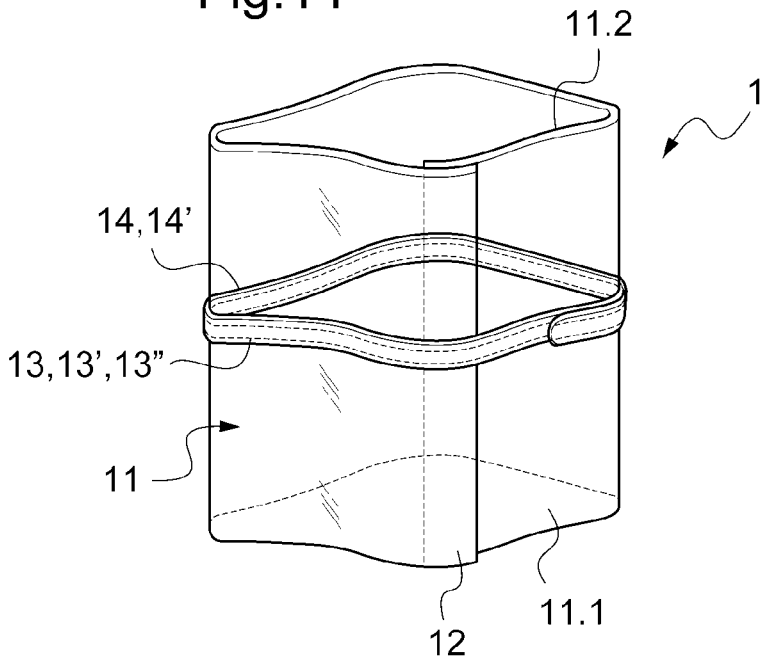
FIG. 14 is a perspective view of a variant of FIG. 11 in which the circumferentially-extending window zone no longer relates only to a portion, but rather to the entire periphery of the sleeve.

FIG. 1 shows a protective and packaging wrapper for a container, which wrapper is constituted by a sleeve 10 of heat-shrunk plastics material designed to be shrunk onto the container. The sleeve 10 is obtained from a film 11 that is folded in half to form a closed loop with its two corresponding end zones being bonded together, e.g. by heat sealing, along a generator line 12. The outside face of the sleeve is referenced 11.1 and the inside face of said sleeve is referenced 11.2.

In accordance with the invention, the film constituting the sleeve 10 is opaque light over is entire area with the exception of a window zone 13, and this window zone 13 is covered on the outside face 11.1 of the sleeve 10 by a detachable adhesive strip 14 that is opaque to light, with removal of said adhesive strip giving access to the window zone 13 and enabling the substance present inside the container to be observed directly by eye.

The flat view of FIG. 2 serves to show the wall 11 of the film constituting the above-mentioned sleeve 10, with its two end zones 12' and 12" that normally overlap, being bonded together before the sleeve is put into place on the corresponding container.

As can be seen from the sections of FIGS. 3*a*, 3*b*, and 3*c*, it is possible to envisage numerous embodiments, both for conferring the opaqueness to light required of the film constituting the sleeve 10, and also for arranging the above-mentioned window zone.

Concerning opaqueness to light, the film constituting the sleeve 10 may be a film of white-colored plastics material that is coated on its face that is to constitute the inside face 11.2 of the sleeve in a layer of an opaque agent conferring a light-barrier property to said film. This embodiment is shown in FIGS. 3*a* and 3*c* where reference 16 designates the layer of opaque agent coating the inside face of the film 11 constituting the sleeve. The opaque agent may be of various colors (black, silver, gold).

In a variant, the film constituting the sleeve 10 may be a film that is made of a plastics material that is opaque, presenting a light-barrier property. This variant is shown in the section of FIG. 3*b*.

Concerning the window zone that constitutes an exception to the zone covered by the sleeve 10 that is opaque to light, it is possible to make provision for the window zone to be constituted by a cutout formed through the wall of the sleeve 10, said cutout then defining at least one through opening. This possibility is shown in FIGS. 3*a* and 3*b*, where there can be seen a cutout 13 that is formed through the wall of the film 11 constituting the sleeve, thereby defining a through opening 18. As can be seen better in FIG. 2, the corresponding through opening is arranged in this example in the form of a narrow slot, which slot specifically extends along a generator line of the sleeve 10.

When one face of the film constituting the sleeve 10 is coated in a layer of opaque agent 16 conferring the light-barrier property to said film, it is possible to make provision for the above-mentioned window zone to be made differently, said window zone being constituted by a coating interruption zone in the layer of opaque agent 16. This is shown in FIG. 3*c*, where it can be seen that there is a coating interrupting zone 13', arranged in this example to form a narrow slot 18', of outline that is identical to the outline formed by the above-mentioned cutout 13. Once more, the narrow slot 18' in this example extends along a generator line of the sleeve 10.

The detachable adhesive strip 14 needs to be opaque to light. As with the film constituting the sleeve, it is thus possible to arrange for the detachable adhesive strip 14 to be opaque to light either by using a strip made of a white film that is coated on its face that faces the outside face of the sleeve 10 with a layer of opaque agent conferring a light-barrier property to said strip, as shown in FIG. 3*a* or 3*c*, said layer of opaque agent being referenced 17, or else, in a variant, it is possible to use a strip made of a film that is itself opaque, being made of a material that presents a light-barrier property, as shown in FIG. 3*b*. In any event, regardless of whether the corresponding application face of the detachable adhesive strip 14 is or is not coated in a layer of opaque agent, this face is always coated in an adhesive (not shown in the figures) enabling it to be fastened on the wall of the film constituting the sleeve, so as to cover the above-mentioned window zone 13 or 13'.

Specifically, it is very important for the window zone 13 or 13' to be covered by the detachable adhesive strip 14 since it is the strip that guarantees that the barrier against light radiation is preserved and thus that the substance present in the container is protected. As a result, for safety reasons, provision is generally made for the detachable adhesive strip to be of dimensions that are slightly greater than those of the corresponding window zone. In the example shown herein, there is a narrow slot 18 or 18' of rectangular shape with a width that may be of the order of 5 millimeters, for example, and a height that may for example be of the order of 50% to 60% of the height of the sleeve. Under such circumstances, the detachable adhesive strip 14 should have, for example, a width of 8 millimeters in order to guarantee overlap on both sides over the full height of the slot, and a height that may match the full height of the sleeve as shown, and indeed that may include a projecting end 15 for gripping so as to facilitate removal of said strip.

In FIG. 4, the above-described protective and packaging wrapper can be seen put into place and heat-shrunk on a container 1, which may be a bottle, a baby bottle, or any type of container in the food, pharmaceutical, or medical domains. In FIG. 4, it can be seen that the detachable adhesive strip 14 masks the entire window zone 13 or 13', such that the substance present in the container 1 is completely protected against light radiation.

In FIG. 5, the adhesive strip 14 has just been removed, thereby giving access to the above-mentioned window zone, defining a narrow slot 18 or 18' that enables the substance present inside the container to be observed directly by eye, and thus makes it possible to verify the level of said substance, or the presence thereof, or indeed that the substance is properly mixed.

As shown in FIG. 5, provision may naturally be made for a scale 50 to be previously printed on the outside face of the sleeve, in the vicinity of a vertical edge of the narrow slot 18 or 18'. This is particularly advantageous when the container is a baby bottle, since this makes it possible to verify visually the quantity of liquid concerned.

The narrow slot 18 or 18' as described above is shown as having the shape of a thin rectangle extending heightwise (along a generator line of the sleeve), however it could naturally have some other shape, or other variants could be provided in which the cutout in the wall or the coating interruption zone in the layer of opaque agent defines a plurality of small window zones, e.g. a succession of dots or dashes (variants not shown).

In the above-described embodiments, the window zone is constituted either by a cutout made in the wall of the sleeve 10, or by a coating interruption zone in the layer of opaque agent coating the inside face of said sleeve. Nevertheless, it is possible to arrange the above-mentioned window zone in yet other ways while still conserving the above-described advantages. One such variant is shown in FIGS. 6 to 10.

In FIGS. 6 to 10, the protective and packaging wrapper differs from that described above with reference to FIGS. 1 to 5 by the fact that the window zone is constituted by at least one line of microperforations 13" formed in the wall of the sleeve 10, said at least one line of microperforations defining a through opening 18" after the corresponding zone 19" has been removed.

Once more, it can be seen that the line of microperforations 13" is arranged to form a narrow slot 18" that is analogous to the above-described narrow slots 18 and 18', but this is merely one example.

As shown in FIGS. 8*a* and 8*b*, when using a line of microperforations 13", here extending around a rectangular outline, the film constituting the sleeve 10 is made opaque to light either by being coated in a layer of opaque agent 16 on the inside face of a film made of white material as shown in FIG. 8*a*, or by using a film made of a material that is itself opaque, i.e. a material that presents a light-barrier property, as shown in FIG. 8*b*.

The presence of the detachable adhesive strip 14', having the primary function of covering the window zone 13" in order to preserve opaqueness to light, provides means that are immediately available for removing the corresponding zone 19" that is defined by the line of microperforations 13". Thus, the detachable adhesive strip 14' is advantageously also a tear-off strip, with removal of said strip simultaneously giving access to the window zone 13" and removing the above-mentioned corresponding zone 19". This is shown in FIGS. 9 and 10, where the wrapper 10 can be seen heat-shrunk on the container 1 respectively before and after removal of the detachable adhesive strip 14', which is additionally a tear-off strip.

Once more, provision may be made for printing a scale 50 on the outside face of the film, along a vertical edge of the narrow slot 18" that is formed by the line of microperforations 13", as shown in FIG. 10.

As mentioned above, the narrow slot 18", here extending along a generator line of the sleeve 10, could be made in the form of a plurality of windows, e.g. a row made up of circular dots or of dashes.

In the variant described above with reference to FIGS. 6 to 10, it is appropriate to select the adhesive that is coated on the inside face of the detachable adhesive strip 14' in such a manner that removing the strip is effective in rupturing the line of perforations 13" and consequently in detaching the corresponding zone 19", without otherwise spoiling the outside face of the sleeve at the periphery of the window zone 13".

As before, the detachable adhesive strip 14', which is opaque to light, may be made either from a film of white material that is coated on its face that faces towards the outside face of the sleeve 10 with a layer of opaque agent conferring a light-barrier property to said strip, or in a variant it may be made of a film of material that is itself opaque, said material presenting a light-barrier property.

In FIGS. 11 to 13, there can be seen another variant in which the window zone 13, 13', 13", and the detachable adhesive strip 14, 14', 14" that covers it no longer extends along a generator line of the sleeve 10, but instead extend circumferentially over at least a fraction of the periphery of the sleeve 10. FIGS. 12 and 13 show such a wrapper heat-shrunk on the container 1, respectively before and after removal of the detachable adhesive strip 14 or 14'.

In FIGS. 11 to 13, the narrow slot 18, 18', 18" that extends circumferentially occupies only a fraction of the periphery of the sleeve, e.g. a fraction that is limited to one-third or one-fourth thereof.

Figure 15:
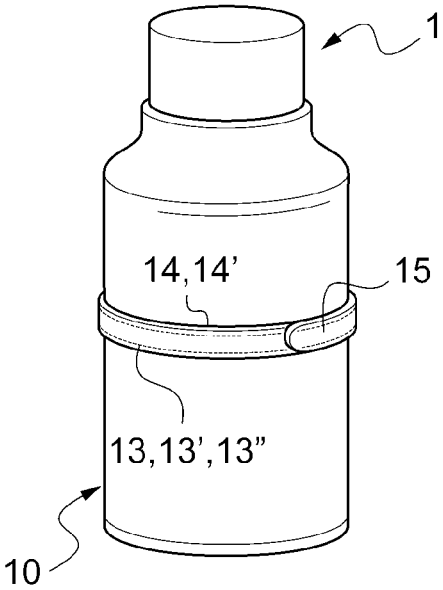
FIGS. 15 and 16 show the FIG. 14 protective and packaging wrapper heat-shrunk onto a container, respectively before and after removal of the detachable adhesive strip.
Figure 16:
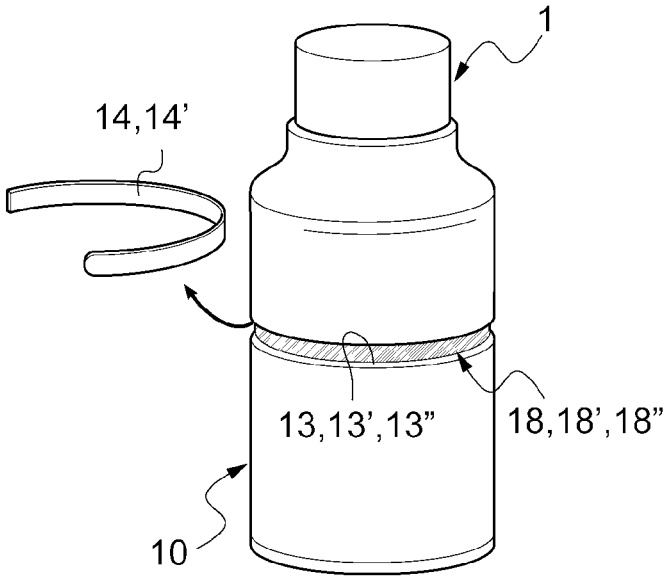

In a variant of a circumferential arrangement, provision may be made to occupy the entire periphery of the sleeve 10, as shown in FIGS. 14 to 16. In FIGS. 15 and 16 there can thus be seen such a variant wrapper respectively before and after removal of the detachable adhesive strip 14 or 14'. The narrow slot 18, 18', 18" that continues to extend in a circumferential direction, here enables the entire circumference of the container to be uncovered over a window that occupies a complete 360° circle.

Such a variant of the circumferential arrangement is suitable for use in particular for visually verifying that the substance is present or that said substance is properly mixed. When it is the level of the substance inside the container that is to be verified, be that substance a liquid or a powder, it is preferable to use an arrangement extending along a generator line of the sleeve, in accordance with the invention described above with reference to FIGS. 1 to 10.

A protective and packaging wrapper has thus been provided for a container that makes it possible to observe the substance present inside the container directly by eye without harming the light barrier capacity of the wall.

While the present invention has been illustrated and described with respect to a particular embodiment thereof, it should be appreciated by those of ordinary skill in the art that various modifications to this invention may be made without departing from the spirit and scope of the present.

What is claimed is:

1. A protective and packaging wrapper for a container, the wrapper being constituted by a sleeve of heat-shrink plastics material for shrinking onto the container, said sleeve being obtained from a film that is folded in half and looped by bonding together its two corresponding end zones, wherein the film constituting the sleeve is opaque to light over its entire area with the exception of a window zone, and the above-mentioned window zone is covered on the outside face of the sleeve by a detachable adhesive strip that is opaque to light, removal of said adhesive strip giving access to the window zone and making it possible to observe the substance present inside the container directly by eye.

2. The protective and packaging wrapper according to claim 1, wherein the film constituting the sleeve is a film of white material that is coated on its face that is to constitute the inside face of said sleeve, in a layer of opaque agent conferring a light-barrier property to said film.

3. The protective and packaging wrapper according to claim 2, wherein the window zone is constituted by a coating interruption zone in the layer of opaque agent.

4. The protective and packaging wrapper according to claim 3, wherein the coating interruption zone is arranged to form a narrow slot.

5. The protective and packaging wrapper according to claim 1, wherein the film constituting the sleeve is a film that is itself opaque, being made of a material that presents a light-barrier property.

6. The protective and packaging wrapper according to claim 2, wherein the window zone is constituted by a cutout formed in the wall of the sleeve, said cutout defining at least one through opening.

7. The protective and packaging wrapper according to claim 6, wherein the cutout is arranged to form a narrow slot.

8. The protective and packaging wrapper according to claim 2, wherein the window zone is constituted by at least one line of microperforations formed in the wall of the sleeve, said at least one line of microperforations defining a through opening after the corresponding zone has been removed.

9. The protective and packaging wrapper according to claim 8, wherein the line of microperforations is arranged to form a narrow slot.

10. The protective and packaging wrapper according to claim 8, wherein the detachable adhesive strip is also a tear-off strip, removal of said strip simultaneously giving access to the window zone and removing the corresponding zone.

11. The protective and packaging wrapper according to claim 4, wherein the narrow slot extends along a generator line of the sleeve.

12. The protective and packaging wrapper according to claim 4, wherein the narrow slot extends circumferentially, over at least a fraction of the periphery of the sleeve.

13. The protective and packaging wrapper according to claim 1, wherein the detachable adhesive strip is made from a film of white material coated on its face that faces towards the outside face of the sleeve in a layer of opaque agent conferring a light-barrier property to said strip.

14. The protective and packaging wrapper according to claim 1, wherein the detachable adhesive strip is made from a film of opaque material that presents a light-barrier property.

15. The protective and packaging wrapper according to claim 5, wherein the window zone is constituted by a cutout formed in the wall of the sleeve, said cutout defining at least one through opening.

16. The protective and packaging wrapper according to claim 5, wherein the window zone is constituted by at least one line of microperforations formed in the wall of the sleeve, said at least one line of microperforations defining a through opening after the corresponding zone has been removed.

* * * * *